US008870330B1

(12) United States Patent
Borrell Avila et al.

(10) Patent No.: US 8,870,330 B1
(45) Date of Patent: Oct. 28, 2014

(54) PRINTING SYSTEM AND METHOD

(71) Applicant: Hewlett-Packard Development Company, L.P., Houston, TX (US)

(72) Inventors: Oriol Borrell Avila, Sant Cugat del Valles (ES); Laura Sánchez Domingo, Sant Cugat del Valles (ES); Mikel Zuza Irurueta, Sant Cugat del Valles (ES); Fco Javier Pérez Gellida, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 25 days.

(21) Appl. No.: 13/861,830

(22) Filed: Apr. 12, 2013

(51) Int. Cl.
*B41J 29/38* (2006.01)
*B41J 11/00* (2006.01)

(52) U.S. Cl.
CPC ..... *B41J 11/0095* (2013.01)
USPC ..... 347/16

(58) Field of Classification Search
USPC ..... 347/19, 16, 14, 9
See application file for complete search history.

(56) References Cited

U.S. PATENT DOCUMENTS

| | | | | |
|---|---|---|---|---|
| 5,632,477 | A * | 5/1997 | Morinaga | 347/14 |
| 5,815,787 | A * | 9/1998 | Crayton et al. | 347/16 |
| 6,352,332 | B1 * | 3/2002 | Walker | 347/19 |
| 6,409,165 | B1 | 6/2002 | Yamaoka et al. | |
| 6,523,925 | B1 | 2/2003 | Driggers | |
| 6,966,713 | B2 | 11/2005 | Kim | |
| 7,063,018 | B2 | 6/2006 | Smythies et al. | |
| 2004/0141021 | A1 | 7/2004 | Yamamoto et al. | |

* cited by examiner

*Primary Examiner* — Kristal Feggins

(57) ABSTRACT

According to one example there is provide a printing system that comprises a carriage moveable bi-directionally across a platen. The system additionally comprises a substrate edge detector to detect the position of a lateral edge of a substrate when positioned on a platen, a parking zone in which a substrate edge holder may be parked, and a substrate edge holder pick-up system on the carriage to pick up a substrate edge holder parked in the parking zone and to position the substrate edge holder on a detected lateral edge of a substrate positioned on the platen.

19 Claims, 4 Drawing Sheets

PRINTING SYSTEM AND METHOD

BACKGROUND

Some printing systems may be used for printing on substrates that have irregular or non-uniform edges. Some substrates, such as some textiles, for example, may have ragged, fibrous, or curled edges.

In some printing systems, such as inkjet printing systems, the distance between a printhead and a substrate in a print zone may be in the order of a few millimeters. Accordingly, any non-uniformity in the substrate edges may lead to physical contact between a substrate and the printhead, which may lead to image quality problems or even printhead damage. Substrate jams may also arise.

In order to print on such substrates, edge holders may be used to hold down substrate edges in proximity to printheads to help prevent such problems.

BRIEF DESCRIPTION

Examples, or embodiments, of the invention will now be described, by way of non-limiting example only, with reference to the accompanying drawings, in which.

DETAILED DESCRIPTION

Some current printing systems may make use of manually positionable edge holders when printing on certain types of substrate. These edge holders are positioned by a printer operator when a roll of substrate is installed in the printing system.

If an operator forgets to install the edge holders when printing on substrates having non-uniform edges, there is a risk of image quality problems or damage to printheads occurring.

If an operator forgets to remove installed edge holders when a new roll of substrate is installed in the printing system, this may be lead to substrate jams when the substrate is installed in the print zone.

If an operator incorrectly places the edge holders, the printing system may print on the edge holder. There may also be an increased risk of substrate jams and printhead damage occurring.

Examples described herein provide a printing system and method of automatically installing edge holders.

Figure 1:
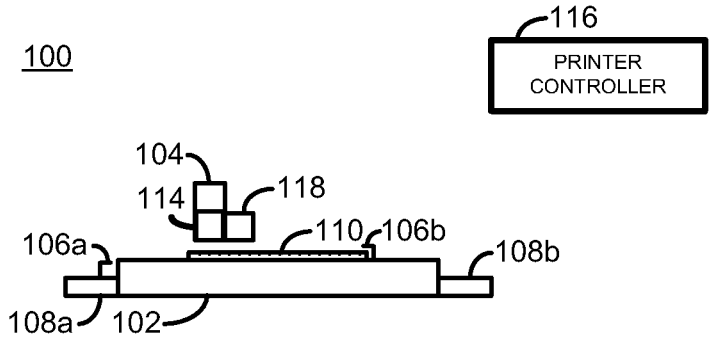
FIG. 1 is a simplified side view illustrating a portion of a printing system according to one example.
Figure 2:
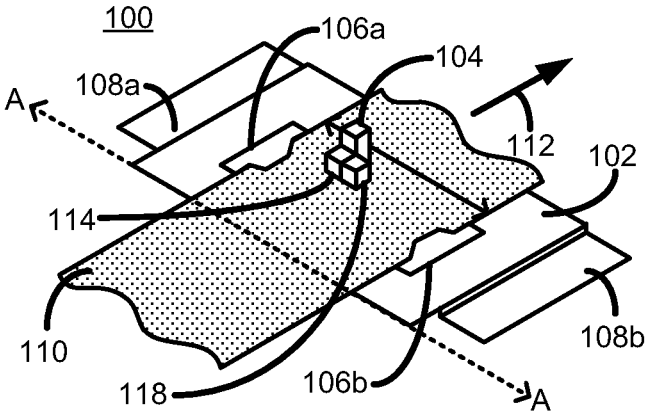
FIG. 2 is a corresponding isometric view of the printing system according to one example.

Referring now to FIG. 1 there is shown a simplified side view illustrating a portion a printing system 100 according to one example. FIG. 2 shows a corresponding isometric view of the printing system 100.

The printing system 100 comprises a platen 102. The platen 102 provides a surface on which a portion of an installed substrate 110 rests. At least a portion of the platen is positioned directly below a path of a printhead. This portion defines a print zone in which printing fluid may be ejected by a printhead onto a substrate.

The substrate 110 may be a sheet of substrate, or may be a web, or roll, of substrate.

In the example shown a printhead 104, such as an inkjet printhead, is installed on a carriage (not shown) that enables the printhead to move bi-directionally along the width of the platen 102.

The operation of the printing system 100 is generally controlled by a printer controller 116.

When controlled in accordance with an image to be printed, the printhead 104 selectively ejects printing fluid drops representing a swath of the image to be printed onto an installed substrate. Depending on how the printing system 100 is configured to operate, a printed swath may be generated in one or in multiple passes of the printhead 104 across the platen 102.

In the example printing system 100 only a single printhead 104 is shown for clarity, although in other examples multiple printheads 104 may be installed on the carriage. For example, in a four color process printing system four printheads, each for printing with one of a cyan, yellow, magenta, and black ink, may be installed on the carriage.

Once a swath has been printed the substrate 110 is advanced in a substrate advance direction 112 perpendicular to the scanning axis of the carriage. Depending on a print mode used by the printing system 100 a subsequent swath may then be printed adjacent to, or overlapping, a previously printed swath. In this way the printing system 100 may produce a printed image in an incremental manner.

To enable the printing system 100 to print on substrates that have irregular lateral edges the printing system 100 utilizes a pair of edge holders 106. The edge holders help prevent irregular substrate edges from contacting nozzles of the printhead 104, for example by vertically restraining the edges in proximity to the edge holder. Although in this example a pair of edge holders is shown, in other examples a printing system may use only a single edge holder.

An edge holder is a shaped element that is designed to be positionable to cover a portion of a lateral edge of a substrate to hold down, or restrain, a substrate edge to prevent the substrate edge from making contact with a printhead, such as printhead 104. The edge holder is removably attachable to the platen 102 such that, when installed, the edge holder does not move as substrate is advanced through the printing system. Depending on the nature of the platen 102, edge holders may be of any suitable shape and size. For example, the height of an edge holder may depend on the type of substrate with which it is to be used, the printhead-to-substrate spacing, and so on.

In one example the pair of edge holders 106 may be identical in shape and may be designed such that they may be placed at either the left or right-hand lateral edge of the substrate 110. In another example each of the edge holders 106*a* and 106*b* may be shaped differently, such that one edge holder is designed to be placed exclusively at a left-hand edge of a substrate, and such that the other edge holder is designed to be placed exclusively at a right-hand edge of a substrate.

In the present example, the edge holders 106 are attachable to the platen 102 using magnetic force. In one example, the platen 102 has ferromagnetic properties and the edge holders 106 comprise one or multiple magnets. In another example the edge holders 106 have ferromagnetic properties and the platen 102 comprises multiple magnets located along the width of the platen 102.

In the printing system 100 each edge holder 106 may be parked in a parking zone when not being used. By 'parked' is meant that an edge holder may be stored in the parking zone in such a manner that it does not affect operation of the printing system 100 when edge holders are not being used during a printing operation. In one example the parking zone is located outside of the print zone.

In the example shown a pair of parking zones 108*a* and 108*b* are shown, each being located at a lateral extremity of the platen 102. In this example, an edge holder 106*a* may be parked in the parking zone 108*a*, and the edge holder 106*b* may be parked in the parking zone 108*b*. In other examples, only a single parking zone may be provided in which both of the edge holders 106 may be parked.

In this example, the parking zones 108 have an upper surface which is lower than the upper surface of the platen 102, such that when an edge holder 106 is positioned in the parking zone the upper surface of the edge holder 106 is below the lower surface of the printhead 104. In this way, a parked edge holder does not interfere with, or enter in contact with, the printhead 104. Furthermore, this enables the printhead to be moved beyond the platen 102 and parking zone 108, for example to reach a printhead servicing module (not shown). In other examples the upper surface of the parking zone 108 may be at the same level as the upper surface of the platen 102.

An edge detector 114 is also provided on the carriage. The edge detector 114 enables the printer controller 116 to determine a precise lateral position of each of the lateral edges the substrate 110. Edge detectors are generally well known, and may comprise, in one example, a light source positioned to shine light towards the platen 102, and a light detector to detect light reflected from the platen 102. For example, the controller 116 may control the carriage to scan across the width of the platen 102, once a substrate is installed thereon, to enable the edge detector 114 to detect a difference in contrast between the color of the platen 102 and the color of the substrate 110. The position of the lateral substrate edges may be determined accordingly.

An edge holder transport system 118 is also provided on the carriage that enables an edge holder to be picked up from a parking zone 108, to be transported to a determined substrate edge, to be deposited on the platen 102 such that a portion of an edge holder 106 covers a portion of the edge of a substrate, and to be removed from the platen 102 and returned to a parking zone 108.

In one example the edge holder transport system 118 includes an electromagnet that, under control from the printer controller 116, is able to selectively exert or not exert a magnetic force, thus enabling an edge holder 106 to be picked up or deposited as required.

In other examples other selective pick up systems may be used, such as using vacuum systems, mechanical hooks, or the like.

Figure 3:
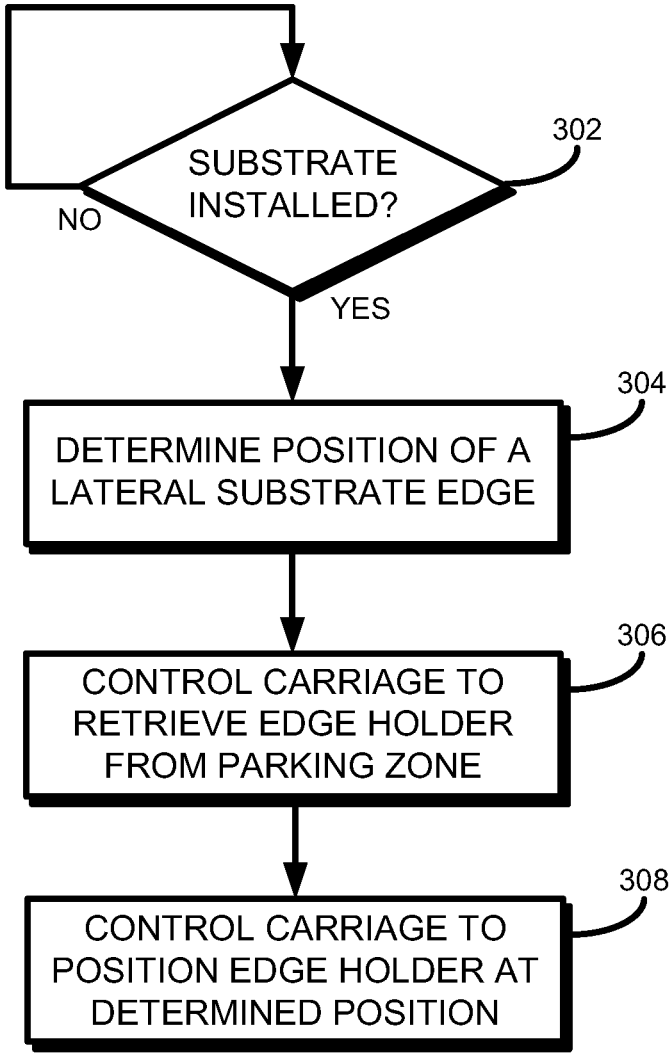
FIG. 3 is a flow diagram outlining an example method of installing an edge holder according to one example.

A method of operating the printing system 100 according to one example will now be described, with additional reference to the flow diagram of FIG. 3.

At block 302 the controller 116 determines whether a substrate has been installed in the printing system 100. In the examples described herein the substrate installed in the printing system 100 is a web, or a roll, of substrate. In other examples, however, individual substrate sheets may be used with appropriate modifications.

In some printing systems, such as large format or industrial printing systems, substrates are typically installed such that they are substantially centered over the platen 102. This is unlike the majority of consumer and enterprise printing systems which typically require one edge of a substrate to be installed against a fixed reference guide. Accordingly, depending on the width of a substrate installed, the position of the both substrate lateral edges may change each time a new substrate is installed.

At block 304 the controller 116 moves the edge detector 114, by moving the carriage, across the platen to enable the edge detector 114 to detect the position of a lateral edge of the installed substrate 110.

In scanning inkjet printers the position of the carriage is determinable to a high degree of accuracy. For example, a carriage may include an optical encoder that reads a high resolution encoder strip included in a carriage bar, thereby enabling the printer controller 116 to accurately determine the position of the carriage. Accordingly, the positions of the edge holder transport system 118 and edge detector 114 may also be accurately determined.

Once the position of a lateral substrate edge has been determined, at block 306 the controller 116 controls the carriage to position the edge holder transport system 118 above an edge holder in a parking zone. In an example where both edge holders are the same shape, the controller 116 may control the carriage to position the edge holder transport system 118 above any edge holder located in a parking zone. In an example where the edge holders are designed for a specific lateral substrate edge, the controller 116 controls the carriage to position the edge holder transport system 118 above an appropriate edge holder 106.

The controller 116 then controls the edge holder transport system 118 to pick up the appropriate edge holder.

At block 308, the controller 116 controls the carriage to position the edge holder transport system 118 to position the edge holder 106 at the determined position above a lateral substrate edge. The controller 116 then controls the edge holder transport system 118 to deposit the edge holder 106 on the platen 102. In this way, a portion of the edge holder 106 is secured to the platen 102, and a portion of the edge holder 106 holds downs, or restrains, a portion of the lateral substrate edge.

If two edge holders are to be installed, blocks 306 and 308 may be repeated.

Figure 4:
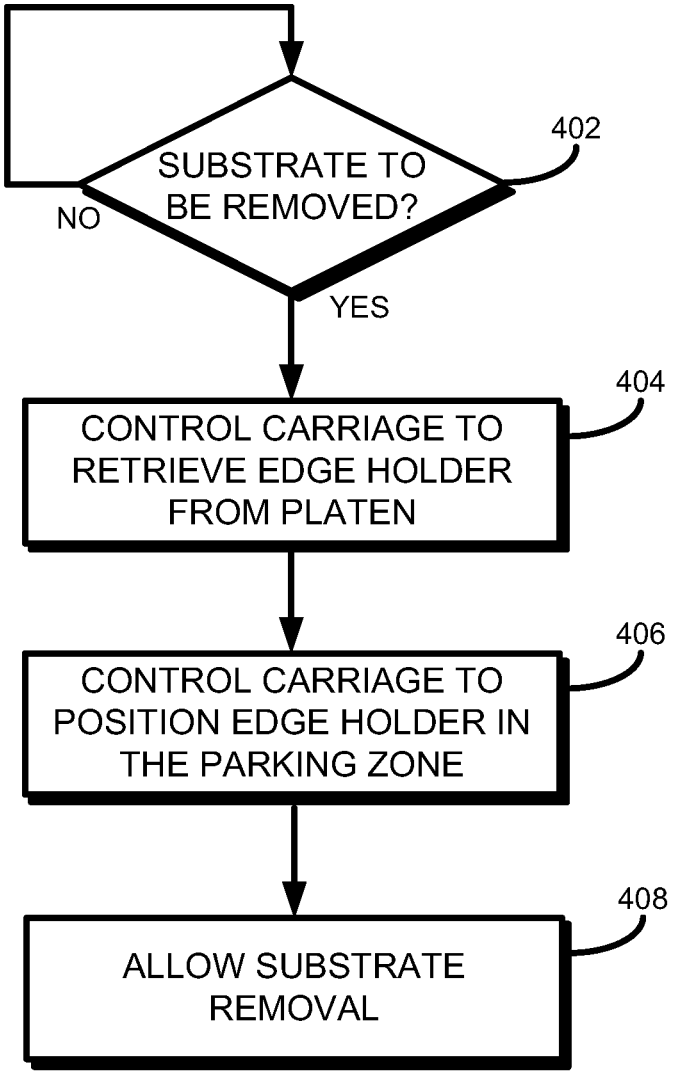
FIG. 4 is a flow diagram outlining an example method of removing an installed edge holder according to one example.

A method of uninstalling or removing a substrate from the printing system 100 will now be described with further reference to the flow diagram of FIG. 4.

At block 402, the controller 116 determines whether a substrate 110 installed in the printing system 100 is to be removed. In one example this may be determined by a user inputting an indication to a printing system user interface (not shown). In another example this may be determined using a sensor to detect when a user opens a portion of the printing system in order to remove a substrate.

At block 404, the controller 116 controls the carriage to position the edge holder transport system 118 above an installed edge holder. The position of the installed edge holder is stored, for example in a memory, such as a non-volatile memory, when the edge holder is installed.

The controller 116 then controls the edge holder transport system 118 to pick up the installed edge holder 106. The controller 116 then controls the carriage to position the edge holder 106 above a parking zone 108, and then controls the edge holder transport system 118 to position the edge holder 106 in the parking zone 108.

Once the edge holder 106 has been positioned in the parking zone 108 the substrate 102 may be removed from the printing system 100.

In one example the printer controller 116 may control the carriage and edge detector 114 to determine the position of an installed edge holder. This may be useful, for example, in the event that the printing system loses the position of an installed edge holder, for example as a result of a memory failure, power problem, or the like. In one example the upper surface of the edge holder may be a predetermined color, or may have a predetermined pattern to enable the controller 116 to determine the position of an installed edge holder.

In a further example, the printing system 100 may be a page-wide array printing system in which an array of printheads (not shown) are arranged to span the whole, or substantially the whole, of the platen 102. In such printing systems the array of printheads are not mounted on a carriage that scans across the width of the platen, but are generally fixed, or have only a limited degree of lateral movement. In this example, a carriage as described above is provided in addition to an array of printheads, that enables the edge detector 114 and edge holder transport system 118 to operate as described above.

Figure 5:
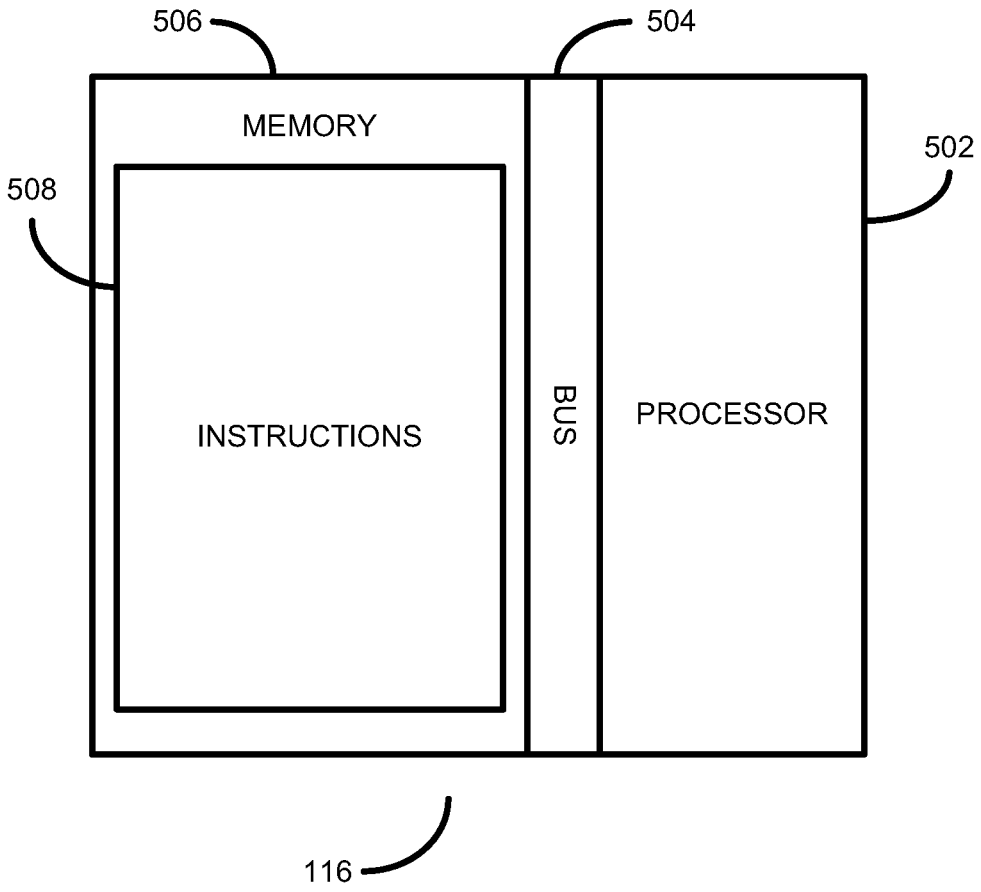
FIG. 5 is a block diagram of a printer controller according to one example.

In one example, as shown in FIG. 5, the printer controller 116 comprises a processor 502, such as a microprocessor or microcontroller, that is coupled to, and is in communication with via a communications bus 504, a memory 506. The memory 506 stores processor understandable instructions 508 that, when executed by the processor 502, cause the processor 502 to perform the method or methods described herein.

The examples described herein provide an automatic edge holder installation and removal system that reduces problems caused by edge holders being incorrectly manually installed. Furthermore, problems caused by edge holders failing to be removed prior to removing a substrate from a printing system are also reduced.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples described herein may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A printing system comprising:

a carriage moveable bi-directionally across a platen;

a substrate edge detector to detect the position of a lateral edge of a substrate when positioned on the platen;

a parking zone in which a substrate edge holder may be parked; and a substrate edge holder pick-up system on the carriage to pick up a substrate edge holder parked in the parking zone and to position the substrate edge holder on a detected lateral edge of a substrate positioned on the platen.

2. The printing system of claim 1, further comprising a controller to:

determine when a substrate has been installed in the printing system;

control the carriage and substrate edge detector to determine the position on the platen of a lateral edge of an installed substrate;

control the carriage and edge holder pick-up system to pick up an edge holder from the parking zone, and to install the edge holder on the print platen such that the edge holder covers a portion of the substrate edge.

3. The printing system of claim 1, wherein the controller is further to:

determine when a substrate is to be uninstalled from the printing system; and control the carriage to pick up an installed edge holder, to move the edge holder to the parking zone, and to deposit the edge holder in the parking zone.

4. The printing system of claim 3, wherein the controller is further configured to determine the position of an installed edge holder using the substrate edge detector.

5. The printing system of claim 1, wherein the parking zone is at a lateral extremity of the platen.

6. The printing system of claim 1, wherein a printhead is installable on the carriage for ejecting printing fluid drops on a substrate on the platen, and wherein the parking zone is situated below the level of the platen such that when an edge holder is parked thereon the upper surface of the edge holder is below the lower surface of the printhead.

7. The printing system of claim 1, wherein the platen exhibits ferromagnetic properties and wherein the edge holder comprises one or multiple magnets to attract it to and secure it to the platen.

8. The printing system of claim 7, wherein the parking zone exhibits ferromagnetic properties.

9. The printing system of claim 1, wherein the edge holder pick-up system comprises one of: an electromagnet; a vacuum system; and a mechanical attachment mechanism, and wherein the force exerted by the pick-up system is stronger than the magnetic force between the platen and the edge holder.

10. The printing system of claim 1, wherein the printing system comprises a pair of edge holders, and wherein the parking zone is configured to store the pair of edge holders.

11. The printing system of claim 10, wherein the system comprises a pair of parking zones at each lateral end of the platen, and wherein each parking zone is configured to store a single edge holder.

12. The printing system of claim 11, wherein each of the pair of edge holders are different and are designed for a specific one of the lateral substrate edges.

13. The printing system of claim 1, wherein the parking zone is located outside of a print zone.

14. A method of controlling the placement of substrate edge holders in a printing system, the printing system comprising a carriage moveable bi-directionally across a platen and a substrate edge holder pick-up system, the method comprising:

determining when a substrate has been installed in the printing system;

controlling the carriage and edge holder pick-up system to retrieve an edge holder from a parking zone and to position the edge holder over a lateral edge of an installed substrate.

15. The method of claim 14, wherein the carriage further comprises a substrate edge detector, and wherein the method further comprises:

controlling the carriage and edge detector to determine the position of a lateral edge of the substrate; and positioning the edge holder at the determined position.

16. The method of claim 14, further comprising:

determining when an installed substrate is to be removed from the printing system;

moving the carriage to position the edge holder pick-up system above an installed edge holder;

picking up the installed edge holder with the edge holder pick-up system;

moving the carriage to position the edge holder pick-up system above the parking zone; and depositing the edge holder in the parking zone.

17. The method of claim 16, further comprising determining the position of an installed edge holder by controlling the carriage and edge detector to determine the position of an installed edge holder.

18. The method of claim 14, wherein the printing system comprises a left-hand edge holder and a right-hand edge holder positioned in a parking zone, the method further comprising:

determining the position of a left-hand lateral edge and a right-hand lateral edge of an installed substrate;

moving the carriage to position the edge holder pick-up system above the left-hand edge holder;

picking up the left-hand edge holder with the edge holder pick-up system;

moving the carriage to position the edge holder pick-up system above the determine left-hand substrate edge; and depositing the left-hand edge holder on the platen at the determined position.

19. The method of claim 18, further comprising:

moving the carriage to position the edge holder pick-up system above the right-hand edge holder;

picking up the right-hand edge holder with the edge holder pick-up system;

moving the carriage to position the edge holder pick-up system above the determine right-hand substrate edge; and depositing the right-hand edge holder on the platen at the determined position.

* * * * *